US008138914B2

(12) United States Patent
Wong et al.

(10) Patent No.: US 8,138,914 B2
(45) Date of Patent: Mar. 20, 2012

(54) METHOD AND APPARATUS FOR IMPLEMENTING ENHANCED SIGNATURE CHECKING SECURITY MEASURES FOR SOLAR ENERGY SYSTEMS

(75) Inventors: Man Kit Wong, Los Altos, CA (US); Ivan C. Eng, Santa Clara, CA (US)

(73) Assignee: Man Kit Wong, Los Altos, CA (US)

( * ) Notice: Subject to any disclaimer, the term of this patent is extended or adjusted under 35 U.S.C. 154(b) by 370 days.

(21) Appl. No.: 12/463,355

(22) Filed: May 8, 2009

(65) Prior Publication Data

US 2010/0283612 A1 Nov. 11, 2010

(51) Int. Cl.
*G08B 1/08* (2006.01)

(52) U.S. Cl. ..... 340/539.13; 340/539.11; 340/286.01

(58) Field of Classification Search ..... 340/500, 340/539.11, 539.13, 539.14, 539.16, 286.01, 340/286.02; 700/66; 709/224, 226; 710/6, 710/20; 379/413.02, 413

See application file for complete search history.

(56) References Cited

U.S. PATENT DOCUMENTS

| | | | | |
|---|---|---|---|---|
| 6,481,013 | B1 * | 11/2002 | Dinwiddie et al. | 725/80 |
| 6,519,656 | B2 * | 2/2003 | Kondo et al. | 710/6 |
| 7,027,594 | B2 * | 4/2006 | Casey et al. | 379/413.02 |
| 7,159,022 | B2 * | 1/2007 | Primm et al. | 709/224 |
| 7,379,778 | B2 * | 5/2008 | Hayes et al. | 700/66 |
| 7,406,596 | B2 * | 7/2008 | Tararukhina et al. | 713/165 |
| 7,649,456 | B2 * | 1/2010 | Wakefield et al. | 340/539.13 |

* cited by examiner

*Primary Examiner* — Van T. Trieu
(74) *Attorney, Agent, or Firm* — Yi-Shan Yang

(57) ABSTRACT

A method and a system for securing a device in a single embodiment or in some embodiments, the system comprises a remote module which comprises a switch electrically connected to an electrical input or at electrical output of the device, a serial link comprising a first attribute and configured to connect to at least some of the plurality of portions of the device, and a panel control logic module operatively coupled to the switch, wherein the panel control logic module is configured to issue a first instruction to actuate the switch based at least in part upon a result of checking the first attribute of the serial link. In the single embodiment or in some embodiments, the system comprises a control center comprising a command control logic module and a communication interface configured for wired or wireless communication between the control center and the remote module.

20 Claims, 10 Drawing Sheets

METHOD AND APPARATUS FOR IMPLEMENTING ENHANCED SIGNATURE CHECKING SECURITY MEASURES FOR SOLAR ENERGY SYSTEMS

FIELD OF THE INVENTION

Various embodiments of the invention relate to technologies for implementing security and/or monitoring measures for solar energy system.

BACKGROUND

With the growing popularity of solar panel installation and the high values of photovoltaic modules, cells, or arrays or the solar thermal collectors, there has been an up-rising tread of solar panel theft around the globe. Developed countries such as Germany, Spain, United States, and Australia have all reported missing panels. The recent break-through in the manufacturing sod technology of the solar panel systems, global awareness of the severity of the global warming effects, and government subsidies in the installation of photovoltaic modules or panels as an initiative to slow down the global warming effect certainly exacerbate the problem. Some governments have even abandoned certain solar-power programs due to the vulnerability of the solar energy systems to theft or looting.

To counteract this prevailing looting or theft of these photovoltaic modules/panels/arrays or solar thermal collectors, some owners of these modules, panels, or collectors use fences, complicated locking mechanisms, color coding, or video surveillance and/or monitoring systems. The above security measures offer limited protection of the assets while some protective measures even require complicated installation and are therefore prohibitively expensive. Moreover, the above security measures are generally ineffective and are relatively easy to defeat or bypass. Once these existing security measures are defeated or bypassed, the photovoltaic modules/panels or solar thermal collectors may be removed en masse while the rightful owners are often left with no recourse.

Once these security measures are defeated and these photovoltaic modules/panels or solar thermal collectors are illegally removed, these modules/panels and collectors can be easily resold over the Internet or through some other sales channels at a fraction of the original price. The new owner of these misappropriated photovoltaic modules/panels or solar thermal collectors are generally able to re-install or reuse these modules/panels or collectors with little or no difficulty while paying only a fraction of the original price. Such a low acquisition cost and almost no barrier for the reuse of the misappropriated photovoltaic modules/panels or solar thermal collectors greatly exacerbate this up-rising theft of these module/panels or collectors.

On the other hand, it may be extremely difficult for the rightful owners or their respective insurance companies to, even with the aid of law enforcement, track, identify, and, then recover these stolen photovoltaic modules/panels or solar thermal collectors.

Therefore, there exists a need for an effective method and apparatus for implementing the enhanced signature checking security measures for solar energy systems.

SUMMARY

Various embodiment relate to a method or a multi-function apparatus for monitoring the status of photovoltaic modules/panels, solar thermal collectors, and solar array of a solar energy system, identifying one or more conditions for generating an alarm signal, alerting or informing security provider in case of theft or unauthorized tempering with the photovoltaic modules/panels/arrays and solar thermal collectors, disabling energy production function of the photovoltaic modules/panels/arrays or solar thermal collectors, providing tracking signals for the location of the photovoltaic modules/panels/arrays, solar thermal collectors, and solar array of a solar energy system, and providing a variety of control, monitoring, and communication features related to solar panel. Some embodiments may also apply to any devices that require electric power to operate. For example, various embodiments disclosed herein may also apply to surge protectors, power supplies, universal power backup power supplies, etc.

BRIEF DESCRIPTION OF THE FIGURES

The drawings illustrate the design and utility of preferred embodiments of the present invention. It should be noted that the figures are not drawn to scale and that elements of similar structures or functions are represented by like reference numerals throughout the figures. In order to better appreciate how the above-recited and other advantages and objects of the present inventions are obtained, a more particular description of the present inventions briefly described above will be rendered by reference to specific embodiments thereof, which are illustrated in the accompanying drawings. Understanding that these drawings depict only typical embodiments of the invention and are not therefore to be considered limiting of its scope, the invention will be described and explained with additional, specificity and detail through the use of the accompanying drawings in which.

DETAILED DESCRIPTION

Figure 1:
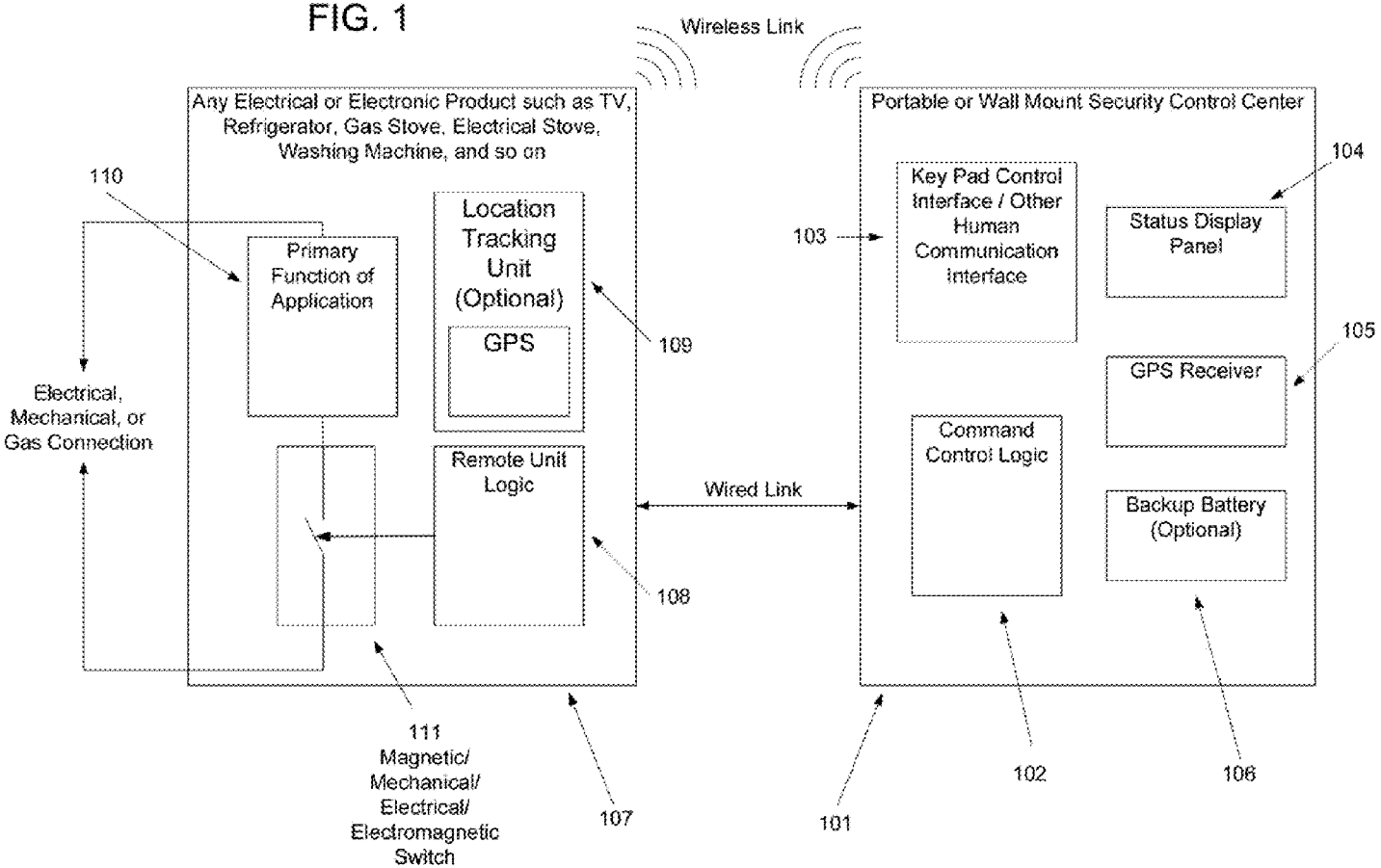
FIG. 1 illustrates a general security system in some embodiments of the invention.

Various embodiment of the invention are directed to a method, apparatus, and system for implementing enhanced signature checking security measures for photovoltaic modules/panels/arrays or solar thermal collectors (hereinafter "solar energy systems" collectively.) Various embodiments of the invention provide security protection for a solar energy system against misappropriation and unauthorized tempering. In a single embodiment or in some embodiments, the method, system, or apparatus comprises a GPS (Global Positioning System) sub-system or module that determines the location of the misappropriated or tempered with portion of the solar energy system such as the photovoltaic panels, cells, modules, or arrays (collectively photovoltaic panels) such that the misappropriated or tempered with portion of the solar system may be recovered by the rightful owners.

In the single embodiment or in some embodiments, tire method, system, or apparatus for may be applied to solar energy systems with a single solar panel or with solar panels that are integrated in parallel or in series. In the single embodiment or in some embodiments, the method, apparatus, and system support both grid-tied or off-grid solar energy systems. In the single embodiment or in some embodiments, the method, apparatus, and system for implementing enhanced signature-checking security measures may be applied to solar energy systems with traditional inverters or micro-inverters. In the single embodiment or in some embodiments, the method, apparatus, and system for implementing; enhanced signature-checking security measures may also be applied to any equipment, that requires electrical power to operate.

In the single embodiment or in some embodiments, the apparatus, and system for implementing enhanced signature checking security measures comprises a photovoltaic panel security remote apparatus which provides security status of the solar energy system being protected and a switch to enable or disable the capability of electricity transmission in or out of the photovoltaic panels. In the single embodiment or in some other embodiments, the apparatus or system may be configured to trigger the discharge of some ink to black out the photovoltaic panel upon the occurrence of certain conditions.

For example, the apparatus or the system may be configured to trigger the discharge of ink to black out the photovoltaic panel upon the detection of tempering with the panel(s) or the security system or upon the failure of certain security checks. In the single embodiment or in some other embodiments, the apparatus or system may be configured to burn the photovoltaic panel upon, the occurrence of certain conditions. For instance, the apparatus or the system may be configured to cause one or more capacitors to discharge sufficient current to disable the photovoltaic panel(s).

In the single embodiment or in some other embodiments, the apparatus or system may be configured to employ a retractable or non-retractable curtain to cover up the photovoltaic panel(s) upon the occurrence of certain conditions. For example, the apparatus or the system may be configured to cause the retractable or non-tractable curtain to deploy upon the detection of tempering with, the panel(s) or the security system or upon the failure of certain security checks. In some embodiments, the photovoltaic panel security remote apparatus may optionally comprise a GPS module or sub-system which provides the location of the GPS module to a receiver. In some embodiments, the GPS module may be integrated within at least, one of the photovoltaic panels of the solar energy system being protected. In some embodiments, the method, apparatus, and system for implementing enhanced signature checking security measures may also comprise a security control center which may be on site with the photovoltaic panels or off site in a remote location, or the security control center may be a portable unit.

In various embodiments, a photovoltaic module or cell or a solar cell refers to a device that converts the total or partial spectrum of the electromagnetic radiation that is given off by the Sun or other sources of electromagnetic radiation directly or indirectly into electricity, electrical powers, or other forms of energy for practical use according to the photovoltaic effects. In various embodiments, the photovoltaic module, panel, or array constitutes a photovoltaic assembly which comprises one or more photovoltaic cells. In some embodiments, a solar cell refers to a device which collects and converts the electromagnetic radiation from the Sun into electricity, electrical powers, or other forms of energy. In these embodiments, a solar panel or a solar module constitutes an assembly which comprises one or more solar cells. The electromagnetic radiation may take the forms of, for example, sunlight or heat. Throughout this specification, the photovoltaic panel(s), module(s), array(s), or cell(s), or the solar panel(s), module(s), array(s), or cell(s) will be referred to hereinafter as photovoltaic panel(s).

Referring to FIG. 1 which illustrates a general security system or apparatus for implementing enhanced signature checking; security measures for solar energy systems in some embodiments of the invention. The general security system or apparatus, 100, comprises a security control center, 101, and a photovoltaic panel security remote unit, 107, in some embodiments. In some embodiments, the security control center, 101, and the photovoltaic panel security remote unit, 108, are configured to be communicatively coupled via a wired link, 152, or wireless link, 154.

In the single embodiment or in some embodiments, the wireless link, 154, may be implemented by rising, for example, radio frequency (RF) technologies, Wi-Fi, ultra-wide band (UWB), Zigbee wireless technology, GSM (global system for mobile communications), GPRS (general packet radio service), EDGE (enhanced data rates for GSM evolution), CDMA (code division multiple access), TDMA (time division multiple access), FDMA (frequency-division multiple access), or any other wireless communication technologies to enable communication between the security control center, 101, and the photovoltaic panel security remote unit, 107. In some embodiments, the wired link, 152, may use technologies such as Ethernet, serial connection such as an RS-232 (recommended standard 232) or RS-48.5 connection, parallel connection such as an IEEE 1284 connection, IEEE 1394 connection, FireWire. USB (universal serial bus), or any other wired communication technologies.

In some embodiments, the security control center, 101, may comprise a handheld or portable device. In other embodiments, the security control center, 101, may be fixedly attached. In various embodiments, the security control center, 101, may work with a single or a plurality of photovoltaic panel, security remote units, 107.

The photovoltaic panel security remote unit, 107, may comprise a primary function of application module, 110, in some embodiments. The primary function of application module, 110, controls functions such, as the functions of a television set or functions of any equipment or devices that require electrical power to operate in some embodiments. The photovoltaic panel security remote unit, 107, may also optionally comprise a location tracking unit, 109, such as a GPS (global positioning system) receiver, a GPS transceiver, or a GPS transmitter (collectively "GPS device") in some embodiments. The location tracking unit, 109, provides the location of the location tracking unit, 109, so in the event of misappropriation or unauthorized tempering of the devices being projected, the location tracking unit 109 may transmit the location to a receiver in some embodiments. In some embodiments, the location, tracking unit 109 may be integrated with the device being protected within or outside of the photovoltaic panel security remote unit, 107.

The photovoltaic panel security remote unit, 107, may also comprise the remote unit logic module, 108, in a single embodiment or in some embodiments. The remote unit logic module, 108, controls the operations of various modules or sub-systems based at least in part upon the logic stored therein in some embodiments. The photovoltaic panel security remote unit, 107, may also comprise a switch, 111, which is operationally coupled to the primary function of application module, 110, to enable or disable one or more primary functions in some embodiments. The switch, 111, may also be operationally or logically coupled to the remote unit logic module, 108, in a single embodiment or in some embodiments.

In the single embodiment or in some embodiments, the switch, 111, may comprise a magnetic switch, an electrical switch, a mechanical switch, a latching switch, an electromagnetic switch, an electromechanical switch, or any other types of switches that serve the intended purposes various embodiments of the invention. In the single embodiment or in some embodiments, the switch is configured to, upon receipt of a triggering signal or upon the failure to receive such a triggering signal, interrupt or to break an electrical circuit which is electrically coupled to the photovoltaic energy generation function of the solar energy system such that the photovoltaic energy generation function is shut down and may not be resumed until the correct signal is transmitted to close the switch.

In addition or in the alternative, the photovoltaic panel security remote unit, 107, may also optionally comprise a power source, 109, to power various modules in the system in a single embodiment or in some embodiments. The power source may comprise a non-rechargeable backup battery or a rechargeable battery that may be recharged by, for example, photovoltaic energy from the devices being protected, or independent of the devices being protected. The power source 109 may also comprise a combination of non-rechargeable and rechargeable batteries.

The various modules or components of the photovoltaic array security system may be implemented via pure software, pure hardware, or a combination of software and hardware such as an EEPROM (electrically erasable programmable read-only memory) or an ASIC (application-specific integrated circuit), a flash, or an FPGA (field-programmable gate arrays). Various modules or components of the photovoltaic array security system that perform one or more determination or decision actions may comprise a processor or a coprocessor such as a central processing unit, a digital/analog signal processor, an arithmetic logic unit, a floating point unit, etc.

Various modules or components of the photovoltaic array security system may comprise one or more storage devices for these modules or components to perform their intended functions. These storage devices may be volatile or nonvolatile and may comprise dynamic or static random access memory, sequential access memory, read only memory, an optical storage medium, a magneto-optical disk, solid state storage devices, semiconductor memory such as a flash memory, a hard disk, phase change memories, a holographic storage medium, a molecular memory, a tape device, or any other storage devices or media that may be used to fulfill the intended purpose of various embodiments of the invention.

In a single embodiment or in some embodiments, the security control center, 101, may comprise a command control unit, 102, and a communication interface, 103, such as a key pad control interface, a voice command control interlace, or other forms of human interface in one embodiment. In the single embodiment or in some other embodiments, the security control center 101 may also comprise a display apparatus, 104, such as a display panel in one embodiment for status display. In the single embodiment or in some embodiments, the security control center 101 may comprise a GPS device, 105. In some embodiments, the GPS module 105 comprises a global positioning system receiver. In some embodiments, the GPS module 105 comprises a global positioning system transceiver which both transmits and receives signals for performing global positioning system functions. In the single embodiment or in some other embodiments, the security control center 101 comprises a power source, 106, such as a rechargeable, non-rechargeable, or a combination of rechargeable and non-rechargeable backup battery to power various modules of the security control center, 101.

Figure 2:
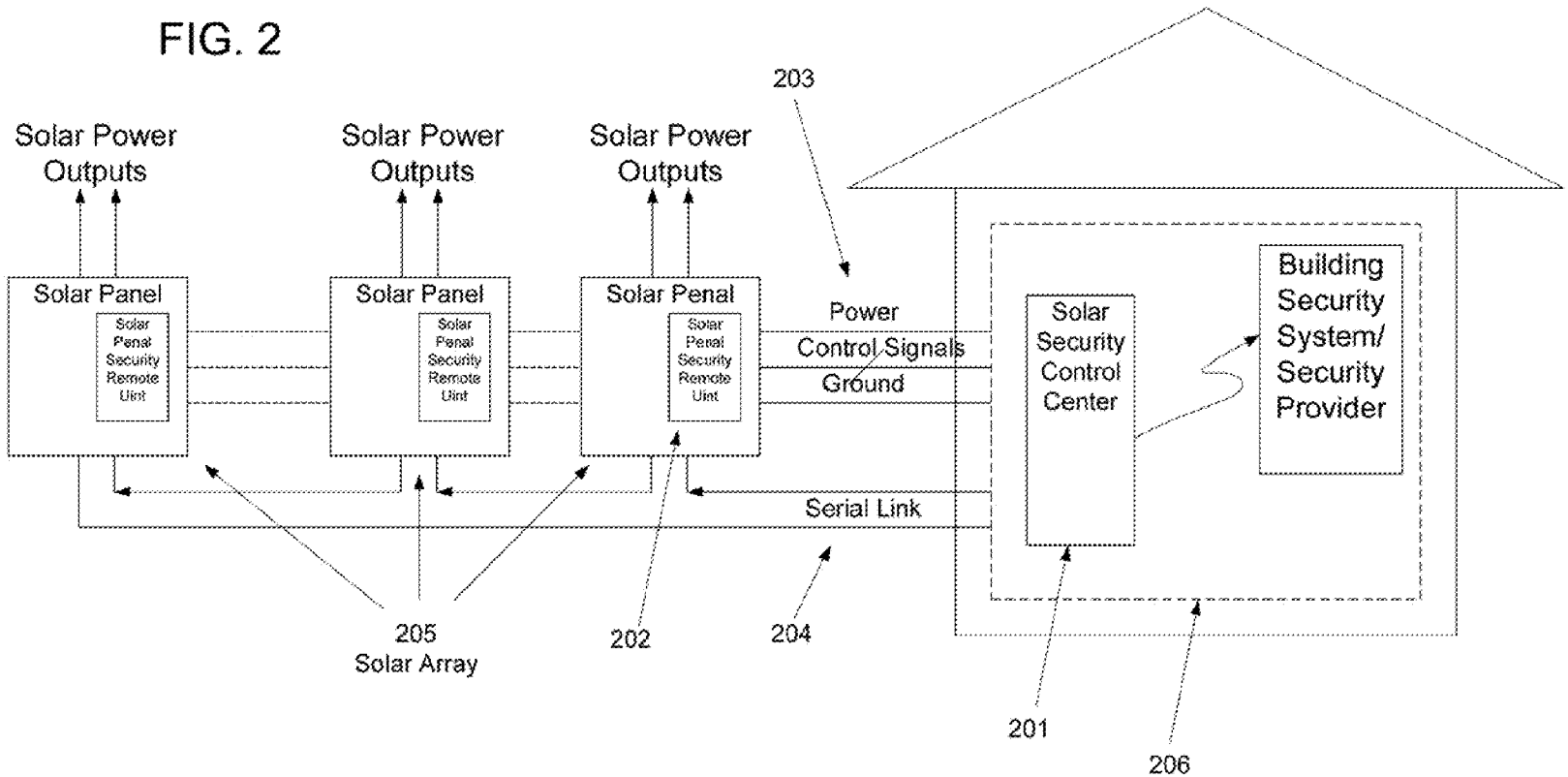
FIG. 2 illustrates a high-level system diagram of a photovoltaic module/panel/array security system in some embodiments of the invention.

Referring to FIG. 2 which a high-level system diagram of a photovoltaic module/panel/array security system (collectively photovoltaic array security system) in some embodiments of the invention, in a single embodiment or in some embodiments, the photovoltaic array security system comprises a photovoltaic security control center, 201, and one or more photovoltaic remote units, 202. In the single embodiment or in some embodiments, the one or more remote units, 202, are powered, by the control center, 201.

In the single embodiment or in some embodiments, the photovoltaic array security system comprises a parallel link, connection 203 and/or a serial link connection, 204, between the control center, 201, and the one or more remote units, 202. The photovoltaic array security system in some embodiments may function independently of an existing security system or security provider, such as a building security system or security provider. In some oilier embodiments, the photovoltaic array security system may function in conjunction with an existing security system or security provider. For example, the photovoltaic array security system may be integrated with an existing security system or security provider into an integrated photovoltaic and building security system, 206.

Figure 3:
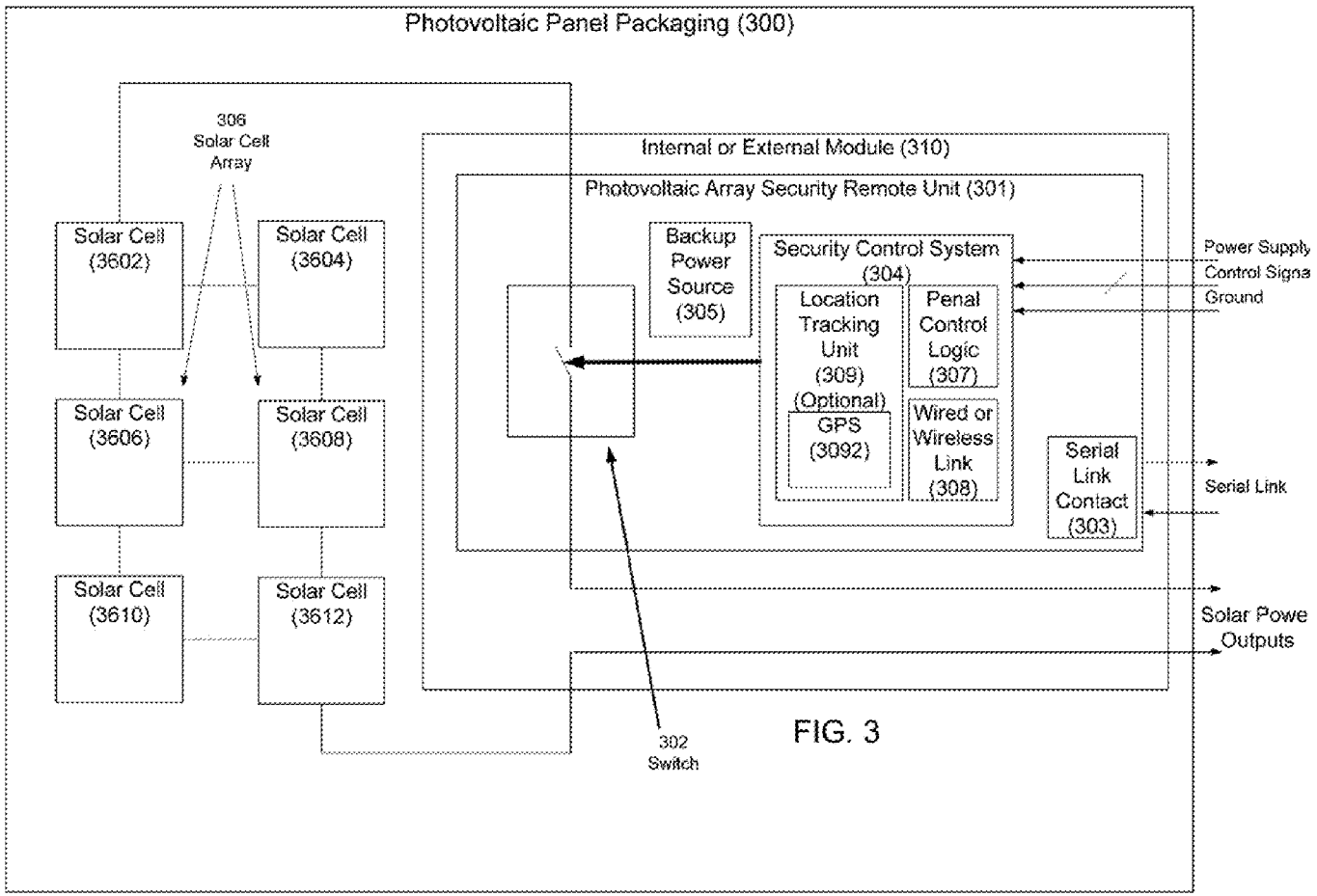
FIG. 3 illustrates a photovoltaic module/panel/array security remote unit diagram in some embodiments.
Figure 6:
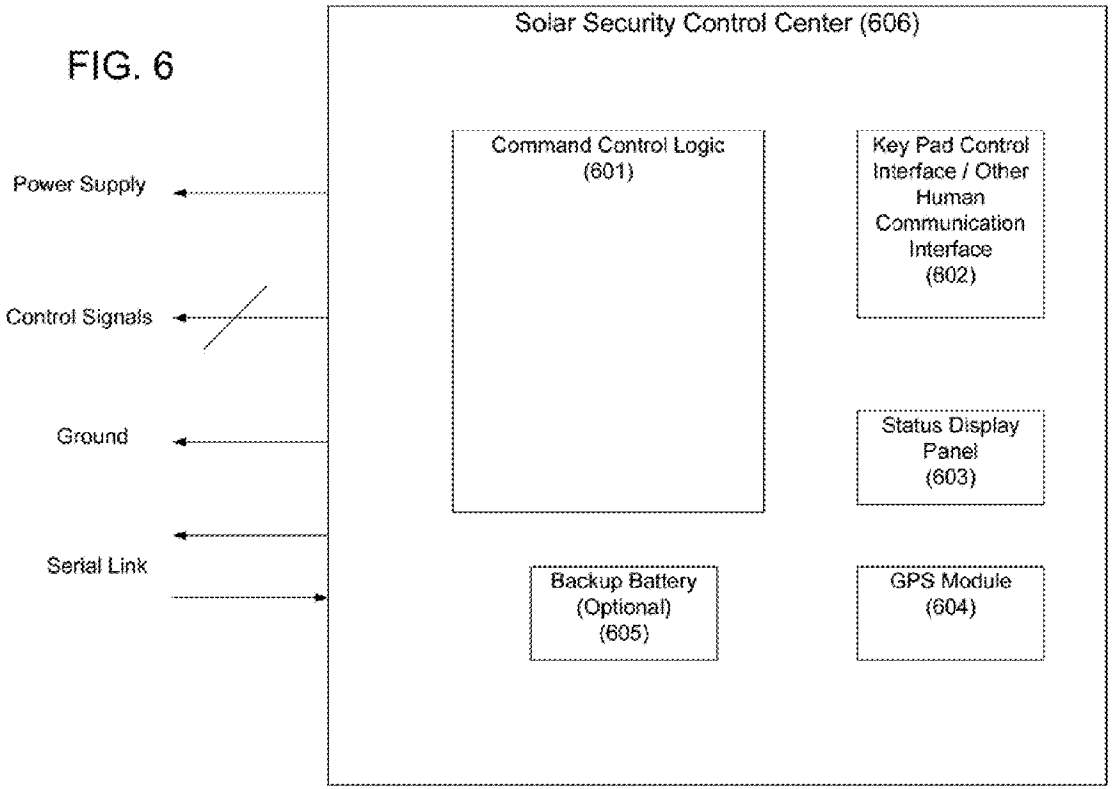
FIG. 6 illustrates a security control center diagram in some embodiments.

Referring to both FIG. 3 which illustrates a photovoltaic module/panel/array security remote unit diagram in some embodiments and FIG. 6 which illustrates a security control center diagram in some embodiments. The command control, logic, 601, in the solar security control center, 606, issues one or more control commands to the panel control logic, 307, through a parallel link (not shown) in a single embodiment or in some embodiments. In the single embodiment, or in some embodiments, the serial link together with the serial link contact, 303, provide security threat alert.

For example, if there is detected an interruption of the serial link, the command control logic, 601, issues a security breach signal to for example, an existing building security system or an existing building security provider in the single embodiment or in some embodiments.

In addition or in the alternative, when the photovoltaic array is tampered with, the one or more photovoltaic array security remote units, 202, shuts down the photovoltaic, power generation functionality of the photovoltaic array(s) in some embodiments. In the single embodiment or in some embodiments, the photovoltaic array security system places a lock on the photovoltaic power generation functionality so the photovoltaic arrays stop functioning until and unless the lock is removed.

For example, when the system is in by-pass mode or when the photovoltaic panels are disconnected from, the security system, or when it is detected that any part of the security system or the photovoltaic arrays lose power, the one or more remote units, 202, shuts down the photovoltaic power generation functionality of the arrays through the use of a switch, 302, in the single embodiments or in some embodiments. In the single embodiment or in some embodiments where any part of the security system or any of the photovoltaic panels lose power, the backup power source, 305, such as a rechargeable, non-rechargeable, or a combination of rechargeable and non-rechargeable batteries may be used to complete the shutting down process. In some embodiments where a device being protected by the photovoltaic array security system is tempered with, the photovoltaic array security system shuts down the power input to the device so the device may not longer function until and unless the lock placed on the power input by the photovoltaic array security system is removed in some embodiments.

The photovoltaic army security remote unit, 301, in FIG. 3 may be situated within or outside of the photovoltaic panels, 310, in a single embodiment, or in some embodiments. The photovoltaic array security remote unit, 301, may comprise a switch, 302, in the single embodiment or in some embodiments. The switch, 302, may comprise a magnetic switch, a mechanical switch, an electrical switch, an electromagnetic switch, or a combination thereof in the single embodiment or in some embodiments. Various implementation of the switch, 302, are illustrated in FIGS. 9-12.

The photovoltaic array security remote unit, 301, may also comprise the panel control logic, 307, a serial link contact, 303, a wired or wireless link, 308, a location tracking unit, 309, or an optional power source comprising a rechargeable battery, a non-rechargeable battery, or a combination thereof in the single embodiment or in some embodiments. In the single embodiment or in some embodiments, the switch, 302, is controlled by the panel control logic, 307, which receives one or more commands form the command control logic, 601, of the photovoltaic array security control center, 201, through one or more parallel links.

Figure 4:
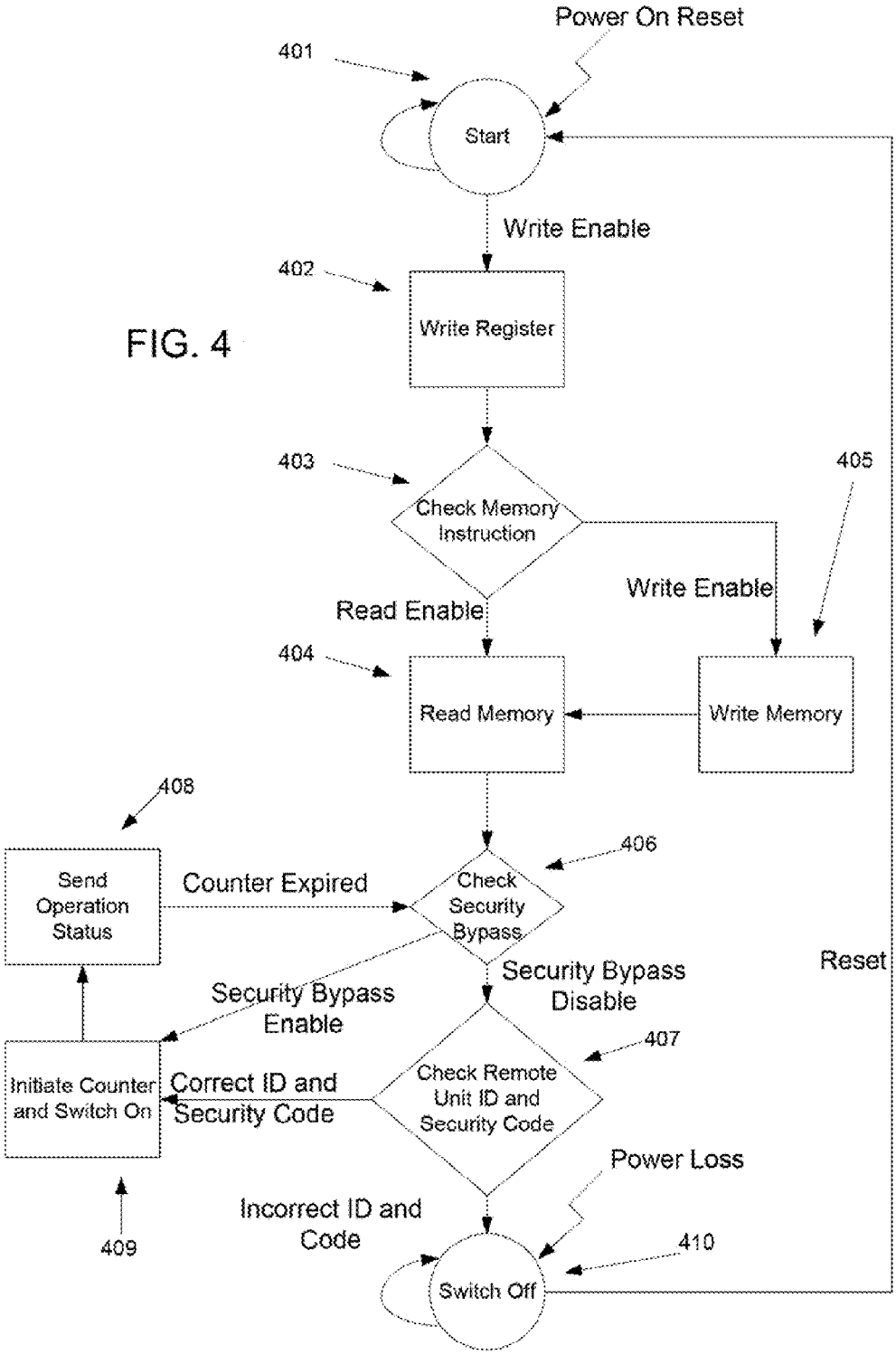
FIG. 4 illustrates a block diagram for the panel control logic of FIG. 3 with a data return path in some embodiments.

In the single embodiment or in some embodiments, the logic flow of the panel control logic, 307, may be implemented by reporting the panel operation status to the photovoltaic array security control center, 201, through one or more serial, links as shown in FIG. 4 which illustrates a block diagram for the panel control logic of FIG. 3 with a data return path. In these embodiments, the panel control logic, 307, may be reset when the power is on. After power on reset, the panel control logic, 307, proceeds to 401 to start the process where the panel control logic, 307, awaits instructions which comprise security bypass, the remote unit identification, or the security code in some embodiments.

In the single embodiment or in some embodiments where no instructions have been received after the power on reset, the panel control logic 307 will remain at the START state, 401. In these embodiments where the panel control logic 307 receives no instructions after the power on reset, the panel control logic 307 may be optionally configured to cause the switch 302 to be opened or de-energized so as to disable or shut down the photovoltaic energy generation function of the system, in these embodiments, the photovoltaic energy generation function remains locked down or inhibited until or unless the lock is removed at 409. In other embodiments, the photovoltaic panel(s) may continue to function as they do from their previous function state or from their factory programmed state if the photovoltaic panels have not been put into services.

In the single embodiment or in some embodiments where one or more instructions are received, the panel control logic, 307, will decode the one or more received instructions and proceeds to the write register, 402. In the single embodiment or in some embodiments, the panel control logic, 307, executes the one or more received instructions accordingly and proceeds to check the security bypass status at 406, depending at least in part upon an action at 403 to check memory instruction to determine whether the one or more received instructions comprises a read memory instruction, 404, and/or a write memory instruction, 405. In the single embodiment or in some embodiments, the panel control logic proceeds to check the photovoltaic array remote, unit identification(s) and/or security code(s) at 407.

In the single embodiment or in some embodiments where the security bypass state is determined to be disabled at 406, and it is determined at 407 that the photovoltaic array remote unit identification and the security code match, the panel control logic, 307, may be configured to remove the lock on and resume the photovoltaic array power generation functionality of the photovoltaic system at 409. In the single embodiment or in some embodiments, each photovoltaic panel may be configured to cause a predetermined security code or identification code to be loaded into the non-volatile memory of its corresponding remote unit logic. For general applications of the method, process, or apparatus to devices, the panel control logic, 307, may be configured to remove the lock on the input power to the device or to disengage the switch to resume the intended functions of the device.

For example, the panel control logic, 307, may be configured to turn on a valve to flow natural gas to or to tutu on power to a gas stove. In the single embodiment or in some embodiments, the panel control logic, 307, may be configured to cause the system to report the status of operation at 408. In the single embodiment or in some embodiments, the panel control logic, 307, may also be configured to comprise an internal counter which tracks or indicates the staleness of various security codes or identification codes for security check purposes on the system. In the single embodiment or in some embodiments, the internal counter may be configured to cause the security code or identification code to associate with a timestamp or a life beyond which, the security code or identification code is deemed invalid. In the single embodiment or in some embodiments, the internal counter may be determined by using the security control unit, in the single embodiment or in some embodiments, the internal counter may be determined by a user or may be pre-programmed through the use of the security control unit.

In the single embodiment or in some embodiments where the security bypass state is determined to be enabled at 406, the panel control logic, 307, may be configured to remove the lock on and resume the photovoltaic array power generation functionality of the photovoltaic system at 409. In the single embodiment or in some embodiments, each photovoltaic panel may be configured to cause a predetermined security code or identification code to be loaded into the non-volatile memory of its corresponding remote unit logic. For general, applications of the method, process, or apparatus to devices, the panel control logic, 307, may be configured to remove the lock on the input power to the device or to disengage the switch to resume the intended functions of the device. In the single embodiment or in some embodiments, the panel control logic 307 may be configured to continue to check the security bypass, the remote unit identification, or the security code even after it is determined that the security bypass has been enabled at 406. In the single embodiment or in these embodiments, the panel control logic 307 may be configured to issue one or more instructions to initialize, re-initialize, or reset the counter at 409. In the single embodiment or in some embodiments, the panel control logic 307 may be configured to postpone checking the security bypass, the remote unit identification, or the security code until it is determined that the security bypass is disabled when it is determined that the security bypass is enabled.

In the single embodiment or in some embodiments where the counter expires or resets due to a predetermined threshold value, the panel control logic, 307, may loop back to 406 to determine whether security bypass is enabled. In the single embodiment or in some embodiments where it is determined that the security bypass state is enabled at 406, the panel control logic 307 may be configured to bypass checking the remote unit identification(s) and/or the security code(s) at 407 and proceeds directly to 409 to remove the lock on and resume the photovoltaic array power generation functionality of the photovoltaic system, at 409.

In the single embodiment or in some embodiments where it is determined that the security bypass state is disabled or not enabled at 406, and that the check on the remote unit identification(s) and/or the security code(s) fails at 407, the panel control logic 307 is configured to de-energize or open the switch, 302, to lock down the solar energy system by shutting down the photovoltaic energy generation functions of the solar energy system at 410. In the single embodiment or in some embodiments, the panel control logic 307 may optionally loop back to 401 either immediately after shutting down the photovoltaic energy generation functions of the solar energy system at 510 or after a period of predetermined or random time period.

In the single embodiment or in some embodiments where the solar energy system is offline, the panel control logic 307 may be configured to keep the switch 302 open and/or to turn on the optional location tracking unit 309 which comprises a GPS receiver, a GPS transceiver, or a GPS transmitter. In the single embodiment or in some embodiments where the security bypass state is determined to be enabled at 406, or where the security bypass is issued by a user or the solar energy system, the panel control logic 307 disables the counter function, disconnects the switch 302, and turns off the location tracking, unit 309 without checking the security code. In the single embodiment or in some embodiments where there is no security bypass, or where the security bypass is disabled, the panel control logic 307 is configured to proceed to verify the security code(s) and enables the counter functionality. In the single, embodiment or in some embodiments, the counter function may be configured to require a period or random security code check.

In the single embodiment or in some embodiments, the security code, the remote unit identification, or a security bypass command comprises a rolling code or a hopping code which may be generated by using a pseudo random number generator or a block cipher such as a non-linear feedback shill register block cipher or a linear feedback shift register block cipher or read from a pre-loaded memory look-up table.

In the single embodiment or in some embodiments, the pseudo random number generator may be integrated with the command control logic and with the panel control logic such that a security code, a remote unit identification, or a security bypass code generated by the pseudo random number generator associated with the command control logic may be verified and checked by the corresponding pseudo random number generator associated with the panel control logic.

In the single embodiment or in some embodiments, the command control logic issues a plurality of rolling codes for the panel control logic to verify and check. For example, the command control logic may issue 128, 256, or even more security codes sequentially for the panel control logic to cheek and verify.

One advantage of issuing a plurality of rolling codes for verification, is that verifying multiple rolling codes minimizes the risk of inadvertently shutting down the protected devices due to reasons other than what the devices are protected against. Another advantage is to increase the security level and make it much harder for intruder to break the security system. For example, issuing and thus verifying multiple codes minimizes the risk of transmission errors during transmission of the codes between various modules or components within the system.

Another advantage of issuing and thus verifying multiple codes is that it helps restoring or resuming the photovoltaic energy generation function of the solar energy system after, for example, the photovoltaic arrays, but not the command control logic, portion, have been tempered with. For example, some or all of the photovoltaic arrays may have been misappropriated and then recovered for a period of time during which the command control logic portion remained secure and continued to issue, security code(s), remote unit, identification(s), or security bypass code(s) (collectively "security code"), none of which were, successfully verified or checked by die panel control logic due to the misappropriation. When the photovoltaic arrays are eventually recovered and re-integrated with die command control logic, issuing and thus checking and verifying multiple rolling codes makes resuming or reinstating the entire solar energy system an easier task and shortens the time required to place the system back online.

In some embodiments, the issuance and the checking and verification of the security code(s), the security bypass code(s), or the remote unit identification(s) may be done by storing the codes in a data structure on a non-volatile storage medium associated with the command control logic and in another data structure on another storage medium associated with the panel control logic. In some embodiments, the codes stored in the data structure may be encrypted, or the data structure itself may be encrypted to prevent unauthorized access or to enhance security. With the data structures, the panel control logic may check the received security code(s), the remote unit identification(s), or the security bypass code(s) and verify their validity by comparing the codes received against the codes in the data structure associated with the panel control logic. The data structure may comprise an encrypted or non-encrypted look-up table in some embodiments. The data structure may also comprise an encrypted or non-encrypted relational or non-relational database which supports more complicated operations on the database entries in some embodiments.

Figure 5:
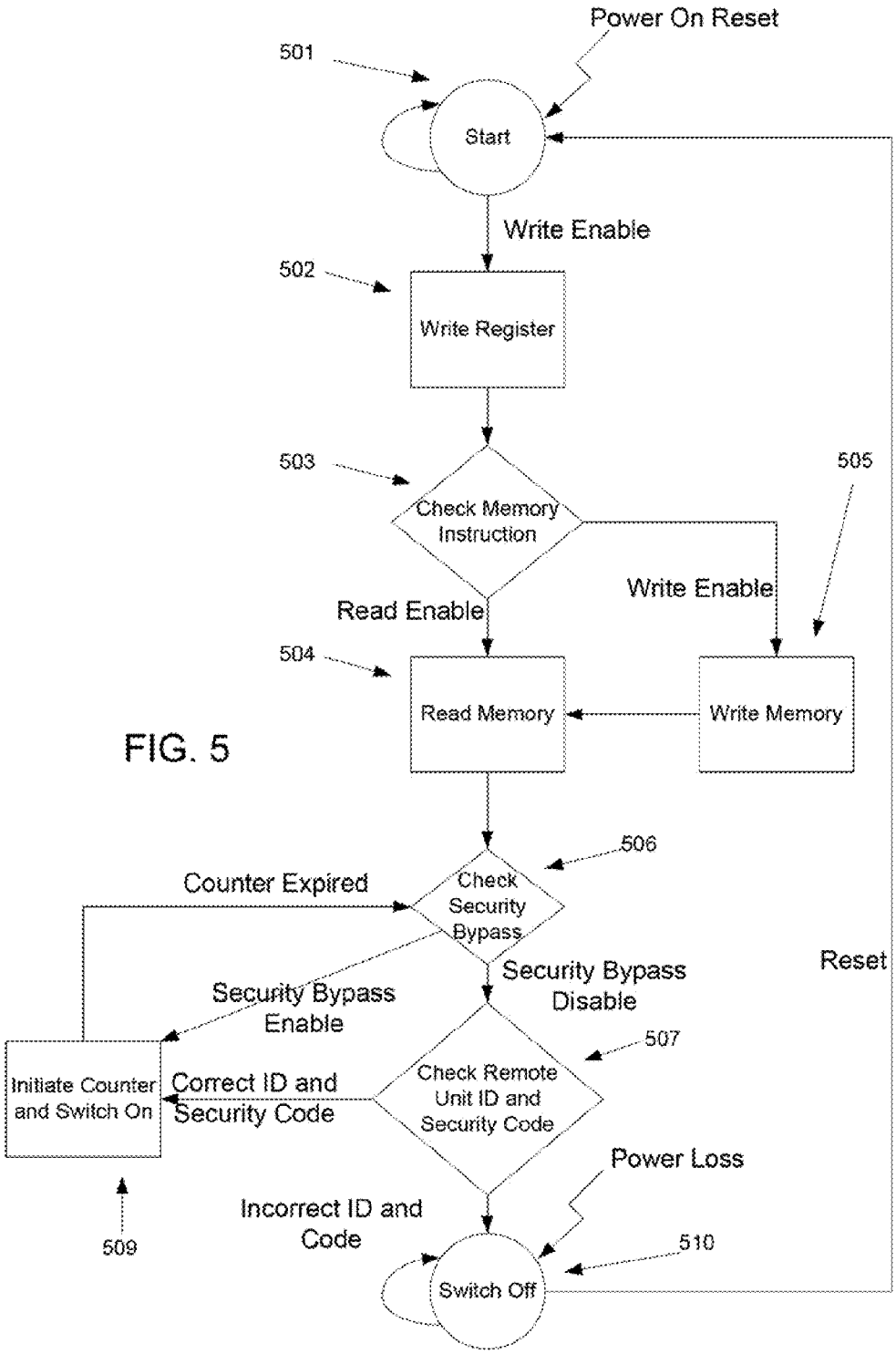
FIG. 5 illustrates a block diagram for the panel control logic of FIG. 3 without a data return path in some embodiments.

In the single embodiment or in some embodiments, the logic flow of the panel control logic, 307, may be implemented without requiring a return data path as illustrated in FIG. 5. After power on reset, the panel control logic, 307, proceeds to 501 where the panel control logic, 307, awaits instructions such as security bypass, the remote unit identification, and/or the security code in the single embodiment or in some embodiments.

In she single embodiment or in some embodiments where no instructions have been received after the power on reset, the panel control logic 307 will remain at the START state, 501.

In the single embodiment or in some embodiments where one or more instructions are received, the panel control logic, 307, will decode the one or more received instructions and proceeds to the write register, 502. In the single embodiment or in some embodiments, the panel control logic, 307, executes the one or more received instructions accordingly and proceeds to check the security bypass status at 506, depending at least in part upon an action at 503 to check memory instruction, to determine whether the one or more received instructions comprises a read memory instruction. 504, and/or a write memory instruction, 505.

In the single embodiment or in some embodiments, the panel control logic proceeds to check the photovoltaic array remote unit identification and security code at 507. In the single embodiment or in some embodiments where the security bypass state is disabled at 506, and it is determined at 507 that the photovoltaic array remote unit identification and the security code match, the panel control logic, 307, may be configured to remove the lock on and resume the photovoltaic array power generation functionality of the photovoltaic system at 509.

In the single embodiment or in some embodiments where the security bypass state is determined to be enabled at 506, the panel control logic, 307, may be configured to remove the lock on and resume the photovoltaic array power generation functionality of the photovoltaic system at 509. In the single embodiment or in some embodiments, each photovoltaic panel may be configured to cause a predetermined security code or identification code to be loaded into the non-volatile memory of its corresponding remote unit logic. For general applications of the method, process, or apparatus to devices, the panel control logic, 307, may be configured to remove the lock on the input power to the device or to disengage the switch to resume the intended functions of the device. In the single embodiment or in some embodiments, the panel control logic 307 may be configured to continue to check the security bypass, the remote unit identification, or the security code even after it is determined that the security bypass has been enabled at 506. In the single embodiment or in these embodiments, the panel control logic 307 may be configured to issue one or more instructions to initialize, re-initialize, or reset the counter at 509. In the single embodiment or in some embodiments, the panel control logic 307 may be configured to postpone checking the security bypass, the remote unit identification, or the security code until it is determined that the security bypass is disabled when it is determined that the security bypass is enabled.

For general application of the method, process, or apparatus to devices, the panel control logic, 307, may be configured to remove the lock on the input power to the device or to disengage the switch to resume the intended functions of the device. In the meantime, the panel control logic, 307, provides individual panel energy production efficiency data to assist monitoring function to identify the problem of any solar panel or panels in a solar energy system.

In the single embodiment or in some embodiments, the panel control logic, 307, may be configured to comprise an internal counter which tracks or indicates various security checks on the system. In the single embodiment or in some embodiments where the counter expires or resets due to a predetermined threshold value, the panel control logic, 307, may loop back to 506 to determine whether security bypass is enabled. In the single embodiment or in some embodiments where it is determined that the security bypass state is enabled at 506, the panel control logic 307 may be configured to bypass checking the remote unit identification and the security code at 507 and proceeds directly to 509 to remove the lock on and resume the photovoltaic array power generation functionality of the photovoltaic system at 509.

In the single embodiment or in some embodiments where it is determined that the security bypass state is disabled or not enabled at 506, and that the check on the remote unit identification and the security code fails at 507, the panel control logic 307 is configured to disengage the switch, 302, to lock down the solar energy system by shutting down the photovoltaic energy generation functions of the solar energy system at 510. In the single embodiment or in some embodiments, the panel control logic 307 may optionally loop back to 501 either immediately after shutting down the photovoltaic energy generation functions of the solar energy system at 510 or after a period of predetermined or random time period.

In the single embodiment or in some embodiments where the solar energy system is offline, the panel control logic 307 may be configured to keep the switch 302 open and/or to turn on the optional location tracking unit 309 which comprises a GPS receiver, a GPS transceiver, or a GPS transmitter. In the single embodiment or in some embodiments where the security bypass state is determined to be enabled at 506, or where the security bypass is issued by a user or the solar energy system, the panel control logic 307 disables the counter function, disconnects or disengages the switch 302, and turns off the location tracking unit 309 without checking the security code.

In the single embodiment or in some embodiments where there is no security bypass, or where the security bypass is disabled, the panel control logic 307 is configured to proceed to verify the security code and enables the counter functionality. In the single embodiment or in some embodiments, the counter function may be configured to require a periodic or random security code check. It shall be noted that, this implementation of the panel control logic 307 requires no return data path and thus does not report the status of the operation as the implementation does at 408 in FIG. 4.

Referring to FIG. 6 which illustrates a security control center diagram in some embodiments. In a single embodiment or in some embodiments, the solar energy system security control center 606 comprises the command control 601, the keypad control, interface or other communication interface(s) 602, the status display panel 603, the optional backup power source 605, and/or a GPS receiver, a GPS transceiver, or a GPS transmitter. The communication interface servers as an input device for the input of one or more control commands in the single, embodiment or in some embodiments.

The command control logic 601 may be configured to check, serial link connectivity in the single embodiment or in some embodiments. The command control logic may also be configured to transmit, relay, issue, or cause to transmit, relay, or issue one or more security codes and/or one or more security bypass commands to panel control, logic, 307, in the single embodiment or in some embodiments. In addition or in the alternative, the command control logic 601 may be configured to service the keypad control interface or communication inter face(s) 602, the status display panel 603, and/or the GPS receiver, transceiver, or transmitter, 604. In the single embodiment or in some embodiments, the one or more serial links may be independently configured and may operate independently of each other. For example, the one or more independent serial links may be configured in a way that the bypass of or the tempering with one of the one or more independent serial links does not interrupt the normal operation of the remainder of the one or more independent serial links. In the single embodiment or in these embodiments, the command control logic 601 may be configured to check each of the one or more serial links independently of each other, and the system may shut down the photovoltaic energy generation function upon a determination that at least one of the one or more serial links is being or has been tempered with.

Figure 7:
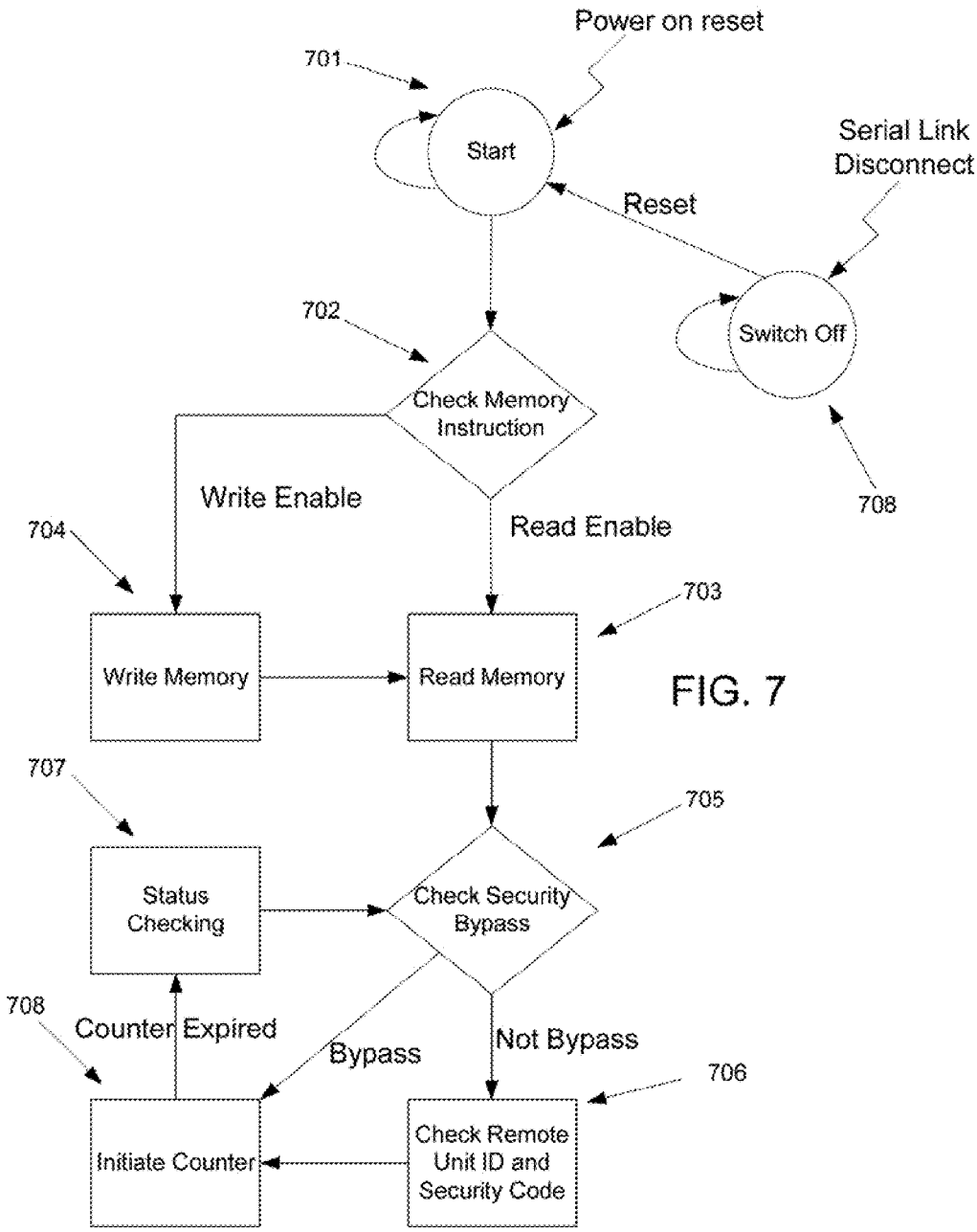
FIG. 7 illustrates a block diagram of the command control logic of FIG. 6 with data return path in some embodiments.
Figure 8:
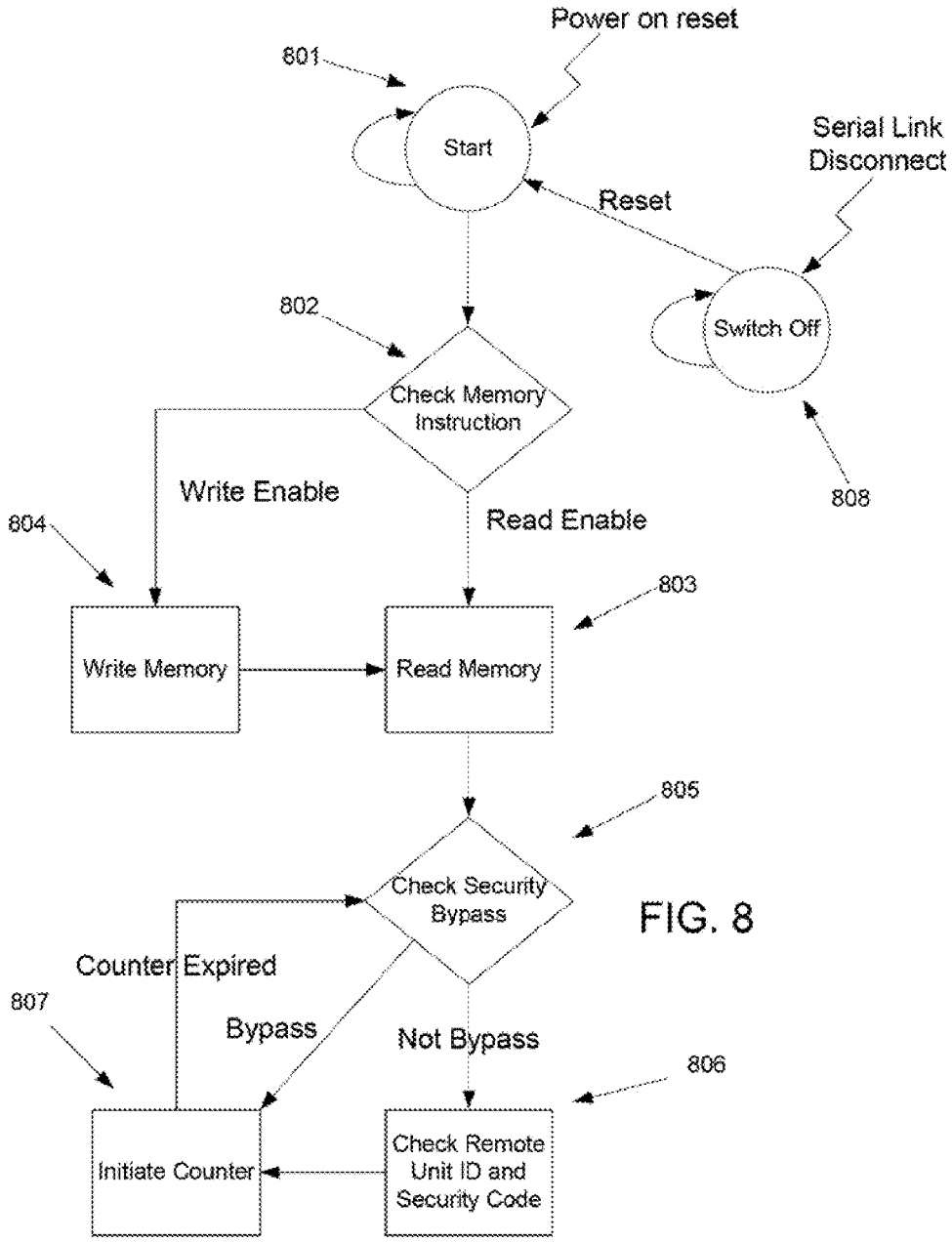
FIG. 8 illustrates a block diagram of the command control logic of FIG. 6 without data return path in some embodiments.

In the single embodiment or in some embodiments, the command control logic 601 may be implemented with a return datapath as illustrated in FIG. 7. In an alternative embodiment or in some other embodiments, the command control logic 601 may be implemented without a return datapath as illustrated in FIG. 8.

Referring to FIG. 7 which illustrates a block diagram of the command control logic of FIG. 6 with data return path in a single embodiment or in some embodiments. In these embodiments, the command control logic 601 after power on reset may be configured to wait for one or more instructions at 701. In the single embodiment or in some embodiments where the command control logic 601 receives no instructions, the command control logic 601 remains at the START state 701.

In the single embodiment or in some embodiments where the command, control logic 601 receives one or more instructions at 701, the command control logic 601 decodes the one or more received instructions and proceeds to 702 to check for memory instruction to determine whether the one or more instructions comprise a write memory instruction, 704, to enable writing to the memory and/or a read memory instruction, 703, to enable reading from the memory. The command control logic 601 then proceeds to 704 and/or 703 according to the determination at 702 to execute the one or more instructions. In the single embodiment, or in some embodiments where die command control logic 601 receives a write memory instruction at 702 and thereafter proceeds to 704, the command control logic 601 also proceeds to 703 to enable reading from memory. In the single embodiment or in some embodiments wherein the command control logic 601 receives a write memory instruction at 702 and thereafter proceeds to 704, the command control logic 601 proceeds directly to 705 without proceeding to 703 to enable reading from the memory at 703.

In the single embodiment or in some embodiments, the command control logic 601 proceeds to 705 to check security bypass or to determine whether the security bypass state has been enabled or disabled. In the single embodiment or in some embodiments where the state of security bypass is disabled, or no security bypass is issued, the command control logic 601 proceeds to check the solar energy system remote unit identification(s) and the security code(s) at 706.

In the single embodiment or in some embodiments, the command control logic, 601, may also be configured to comprise an infernal counter which tracks or indicates various security checks on the system. In the single embodiment or in some embodiments where the counter expires or resets due to a predetermined threshold value, the command control logic, 601, may loop to 707 and then optionally to 705 to determine whether security bypass is enabled.

In the single embodiment or in some, embodiments where the state of security bypass is enabled, or security bypass is issued, the command control logic 601 proceeds to 707 to perform status checking and may optionally loop back to 705. In the single embodiment or in some embodiments, the command control logic 610 checks the connectivity of the serial link(s) within the solar energy system, such as within the photovoltaic arrays 306 in some embodiments. If the integrity of the serial link(s) within the solar energy system is found to be good, or the serial link(s) is (are) not tempered with, the command control logic 601 issues the connectivity signal to the photovoltaic security remote unit(s) 301. In the single embodiment or in some embodiments, the command control logic 601 further issues one or more security bypass commands.

In the single embodiment or in some embodiments where the security bypass state is determined to be enabled at 705, the command control logic 601 may be configured to issue one or more instructions to initialize, re-initialize, or reset, the counter at 708. In die single embodiment or in some embodiments, the command control logic 601 may be configured to postpone checking the security bypass, the remote unit identification, or the security code until it is determined that the security bypass is disabled when it is determined that the security bypass is enabled.

In the single embodiment or in some embodiments where the one or more security bypass signals are not issued, the photovoltaic array security control center 201 is configured to issue one or more security code(s) to the photovoltaic array security remote unit(s) periodically or randomly. In the single embodiment or in some embodiments where the integrity of the serial link(s) is determined to have been tempered with, or where the connectivity check fails, the photovoltaic array security system may be configured to engage the switch, 111 or 302 to shut down and place a lock, on the photovoltaic energy generation function at 708 of the solar energy system and/or to turn on or issue security alert.

Referring to FIG. 8 which a block diagram of the command control logic of FIG. 6 without data return path in a single embodiment, or in some embodiments. In these embodiments, the command control, logic 601 after power on reset may be configured to wait for one or more instructions at 801. In the single embodiment or in some embodiments where the command control logic 601 receives no instructions, the command control logic 601 remains at the START state 801.

In the single embodiment or in some embodiments where the command control logic 601 receives one or more instructions at 801, the command control, logic 601 decodes the one or more received instructions and proceeds to 802 to check for memory instruction to determine whether the one or more instructions comprise a write memory instruction, 804, and/or a read memory instruction, 803. The command control logic 601 then proceeds to 804 and/or 803 according to the determination at 802 to execute the one or more instructions.

In the single embodiment or in some embodiments, the command control logic 601 proceeds to SOS to check security bypass or to determine whether the security bypass state has been enabled or disabled. In the single embodiment or in some embodiments where the state of security bypass is disabled, or no security bypass is issued, the command control logic 601 proceeds to check the solar energy system remote unit identification(s) and the security code(s) at 806.

In the single embodiment or in some embodiments, the command control logic, 601, may also be configured to comprise an internal counter which tracks or indicates various security checks on the system. In the single embodiment or in some embodiments where the counter expires or resets due to a predetermined threshold value, the command control logic, 601, may loop to 807 and then optionally to 805 to determine whether security bypass is enabled. In the single embodiment or in some embodiments where the state of security bypass is enabled, or security bypass is issued, the command control logic 601 proceeds to 807 to perform status checking and may optionally loop back to 805.

In the single embodiment or in some embodiments where the security bypass state is determined to be enabled at 805, the command control logic, 601, may be configured to issue one or more instructions to initialize, re-initialize, or reset, the counter at 807. In the single embodiment or in some embodiments, the command control logic 601 may be configured to postpone checking the security bypass, the remote unit identification, or the security code until it is determined that the security bypass is disabled when it is determined that the security bypass is enabled.

In the single, embodiment or in some embodiments, the command control logic 610 checks the connectivity of the serial link(s) within the solar energy system, such as within the photovoltaic arrays 306 in some embodiments. If the integrity of the serial link(s) within the solar energy system is found to be good, or the serial link(s) is (are) not tempered with, the command control logic 601 issues the connectivity signal to the photovoltaic security remote unit(s) 301.

In the single embodiment or in some embodiments, the command control logic 601 further issues one or more security bypass commands, in the single embodiment or in some embodiments where the one or more security bypass signals are not issued, the photovoltaic array security control center 201 is configured to issue one or more security code(s) to the photovoltaic array security remote unit(s) periodically or randomly.

In the single embodiment or in some embodiments where the integrity of the serial link(s) is determined to have been tempered with, or where, the connectivity check fails, the photovoltaic array security system may be configured to engage the switch, 111 or 302 to shut down and place a lock on the photovoltaic energy generation, function at 808 of the solar energy system and/or to turn on or issue security alert. It shall be noted that in the single embodiment or in some embodiments where the command control logic 601 is implemented without requiring a return data path as illustrated in FIG. 8, and where the counter is determined to have expired, she command control logic 601 loops back to 805 without performing status checking as the command control logic 601 is configured to do in the implementation as illustrated in FIG. 7.

Figure 9:
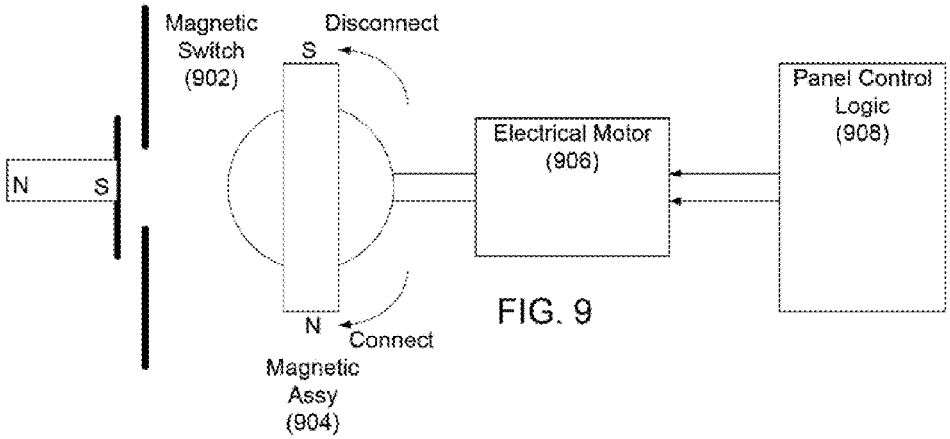
FIGS. 9-12 illustrate some exemplary implementations of the switch in some embodiments of the invention.

Referring to FIG. 9 which, illustrates an exemplary implementation of a magnetic switch in a single embodiment or in some embodiments. In these embodiments, the panel control logic, 908, is electrically coupled to an electrical motor, 906, which is operatively coupled to and drives a magnetic assembly, 904. In these embodiments, a magnetic switch, 902, is operatively coupled to for example, solar energy system to enable or disable the photovoltaic energy generation function, of the solar energy system. In some other embodiments, the magnetic switch may be configured to be operatively coupled to either an input power source or an output power source of a device to enable and disable the input or output of the device by opening and closing the magnetic switch, in these embodiments, the panel control logic 908 is configured to issue a first triggering signal to cause the electrical motor 906 to actuate the magnetic assembly 904 upon a triggering event, in order to open the switch to cause an open circuit.

For example, in the single embodiment or in some embodiments, the command control logic 601 may be configured to detect the serial link connectivity check failure and thereby issue or transmit one or more commands or instructions, such as the security coders) or the remote unit identification(s) in some embodiments, to the panel control logic 908. The panel control logic 908 then checks the remote unit identification(s) or the security code(s) and finds at least one mismatch for either the security code or the remote unit identification, or the panel control logic 908 may determine that the security code(s) or remote unit identification(s) are stale or may have expired without having a security bypass signal to enable the state, of security bypass.

In these cases, the panel, control logic 908 may then be configured to issue an instruction to cause the motor to actuate the magnetic assembly to open the magnetic switch to break the electrical circuit for, for example, the photovoltaic energy generation function of the solar energy system. In tins example, the action of the magnetic switch is controlled by the magnetic field created by the magnet assembly driven by the electric motor and the corresponding magnet on the switch itself.

The photovoltaic energy generation function of the solar energy system may be resumed or reinstated by transmitting a valid security code, a remote unit identification, and/or a security bypass code for the panel control logic 908 to check and compare to determine the validity of the security code, the remote unit identification, or the security bypass code. Once the panel control logic 908 determines that the security code, the remote unit identification, or the security bypass code is valid, the panel control logic 908 may issue another instruction to cause the electric motor to actuate the magnet assembly to close the magnetic switch in order to resume the photovoltaic energy generation function of the solar energy system. The above example is provided for the ease of explanation and for illustration of how the switch may function in one or some embodiments and does not intend to limit the scope of various other embodiments of the invention or the claims.

Figure 10:
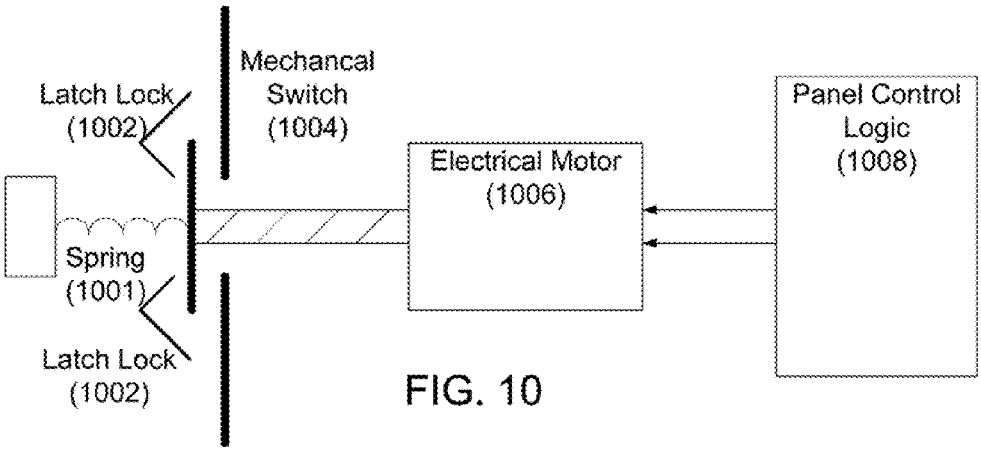

Referring to FIG. 10 which illustrates another exemplary implementation of the switch in some embodiments. In the implementation as shown in FIG. 10, the panel control logic 1008 is operatively coupled to an electric motor 1006. The electric motor 1006 is operatively connected to a mechanical switch 1004, which, in one embodiment, comprises one or more latch locks 1002 and is spring-loaded on one end by, depending on the action of the electric motor 1006, a coil spring or a torsion spring that is connected to the mechanical switch on one end and is fixedly or removably secured on the other end. The implementation of the switch may optionally comprise one or more latch locks 1002 which may be electrically and/or mechanically controlled or configured to prevent inadvertent opening of the switch. Such inadvertent opening may be due to, for example, fluctuations or even loss in the power to the electric motor 1006. In the single embodiment or in some other embodiments, other types of interlocks may also be employed to ensure the opening and closing operation of the switch even in the presence of unexpected deviations from the intended operating environment or conditions.

The panel control logic 1008 may issue appropriate instructions to cause the electric, motor 1006 to actuate—open and close—the mechanical switch 1004 based on, in one embodiment, the successful or unsuccessful checking of the security code, the remote unit identification, or the security bypass code. In some embodiments, the mechanical switch 1004 may be configured to place the spring under certain initial stress such, that the mechanical switch 1004 remains open until and unless the panel control logic 1008 issues appropriate instruction(s) to cause the electric motor 1006 to close the switch 1004.

In other embodiments, the mechanical switch, may be configured to place the spring under certain initial stress such that the mechanical switch remains closed until and unless the panel control logic 1008 issues appropriate instruction(s) to cause the electric motor 1006 to open the switch 1004.

Figure 11:
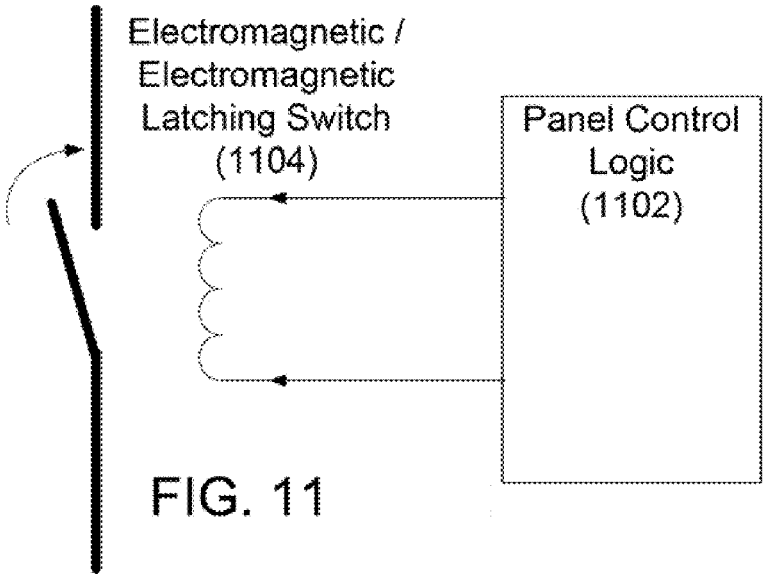

Referring to FIG. 11 which illustrates another exemplary implementation of an electromagnetic switch or an electromagnetic latching switch in some embodiments of the invention. In the configuration or implementation as shown in FIG. 11, the panel control logic 1102 checks the validity of the received security code(s), remote unit identification(s), or security bypass code(s). Depending upon whether the panel control logic 1102 determines the received security code(s), remote unit identification(s), or security bypass code(s) is (are) valid, the panel control logic 1102 issues one or more instructions to the electromagnetic switch or the electromagnetic latching switch 1104. The one or more instructions in the form of electrical current temporarily creates a magnetic field that causes the electromagnetic switch or the electromagnetic latching switch 1104 to open or to close. The electromagnetic switch or the electromagnetic latching switch 1104 may be configured to close or open in the preset ice or absence of an electromagnetic field in some embodiments. The electromagnetic switch or the electromagnetic latching switch 1104 may also be configured to comprise magnetizable members such that the switch or the electromagnetic latching switch 1104 opens or closes upon the issuance of instruction(s) by the panel control logic 1102 without requiring the persistent, presence of an electromagnetic field.

Figure 12:
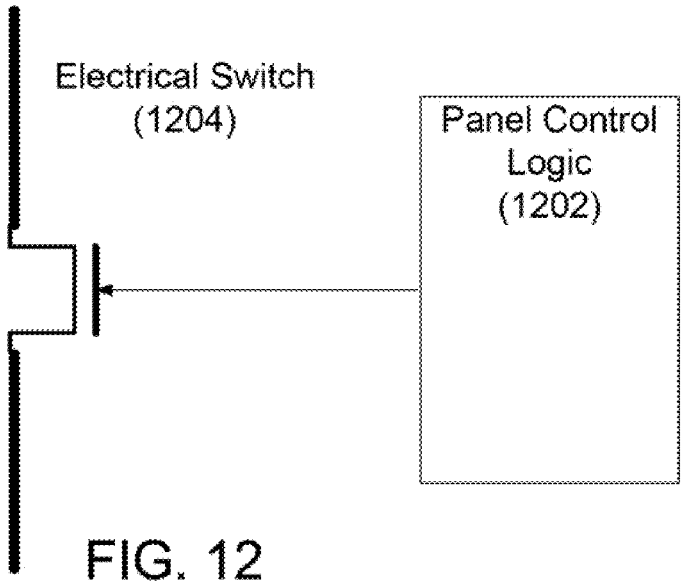

Referring to FIG. 12 which illustrates another exemplary implementation of an electrical switch or a semiconductor switch in some embodiments of the invention. In the implementation as shown in FIG. 12, the panel control logic 1202 checks the validity of the received security code(s), remote unit identification(s), or security bypass code(s). Depending upon whether the panel control logic 1202 determines the received security code(s), remote unit identification(s), or security bypass code(s) is (are) valid, the panel control logic 1202 issues one or more instructions to the switch 1204. In some embodiments where the switch comprises an electrical switch, the panel control logic 1202 causes a proper voltage to be provided to or removed from the electrical switch 1204 in order to close and open the electrical switch 1204. In some embodiments where the switch comprises a semiconductor switch, the panel control logic 1202 causes the semiconductor switch to electronically open, or close by pulsing a semiconductor material disposed between the input and the output.

The foregoing description of various embodiments of the invention are done by way of examples with reference to specific embodiments for explanation and illustration purposes only. These examples, explanations, and illustrations do not, however, intend to limit the scope of various embodiments of the invention or the claimed subject matter(s). In the foregoing specification, the invention has been, described with reference to specific embodiments thereof. It will, however, be evident that various modifications and changes may be made thereto without departing from the broader spirit and scope of the invention. For example, the above-described process flows are described with reference to a particular ordering of process actions. However, the ordering of many of the described process actions may be changed without affecting the scope or operation of the invention. The specification and drawings are, accordingly, to be regarded in an illustrative rather than, restrictive sense.

We claim:

1. A system for implementing enhanced signature checking security measures for protecting a device which comprises a plurality of portions, the system comprising:

a remote module that is integrated or embedded in the device to be protected and comprises:

a switch which is fixedly attached to the device and is electrically connected to an electrical input or an electrical output of the device;

a serial link which comprises a first attribute and connects to at least some of the plurality of portions of the device; and a panel control logic module which is operatively coupled to the switch, wherein the panel control logic module is configured to issue a first instruction to actuate the switch based at least in part upon a result of checking the first attribute of the serial link.

2. The remote module of the system of claim 1, further comprising:

a location tracking module which comprises a global positioning system device.

3. The remote module of the system of claim 1, further comprising:

a backup power source which provides power to the device without diverting or requiring power from the device.

4. The remote module of the system of claim 1, wherein the serial link is configured to connect to a remote control device and maintains electrical connectivity along the serial link.

5. The remote module of the system of claim 1, further comprising a second serial link which comprises a second attribute and connects to at least some of the plurality of portions of the device and a remote control device.

6. The remote module of the system of claim 5, wherein the panel control logic module is configured to issue the first instruction to actuate the switch based at least further in part upon a result of checking the second attribute of the second serial link.

7. The remote module of the system of claim 1, wherein the first instruction to actuate the switch comprises a rolling code, an encrypted code, or a block cipher.

8. The remote module of the system of claim 1, wherein the first attribute of the serial link is checked randomly or periodically.

9. The remote module of the system of claim 1, wherein the panel control logic module is configured to receive and determine validity of a plurality of codes and to issue the first instruction to actuate the switch based at least further in part upon the validity of the plurality of codes.

10. The system of claim 1, further comprising:

a control center which comprises:

a command control logic module; and a communication interface configured for wired or wireless communication between the control center and the remote module.

11. The command control logic module of system of claim 10, where the command control logic module is configured to perform periodic or random check on the first attribute of the serial link and to transmit at least part of a result of the periodic or random check on the first attribute to the remote module.

12. The command control logic module of system of claim 10, where the command control logic module is configured to issue one or more security codes periodically or randomly for the remote module to examine.

13. The system of claim 12, wherein the panel control logic module determines whether the one or more security codes issued by the command control logic module are stale.

14. The system of claim 10, wherein the control center further comprises a global positioning system device configured to locate a location of the remote module, a backup power source, a control interface configured for processing interactions between a user and the control center, or a status display panel configured to display an operation status of the apparatus.

15. The system of claim 1, wherein the device comprises a photovoltaic energy system which comprises one or more photovoltaic energy generation arrays in the at least some of the plurality of portions.

16. The system of claim 15, wherein the photovoltaic energy system comprises one or more grid-tied or off-grid photovoltaic energy systems or a combination of one or more grid-tied or off-grid photovoltaic energy systems.

17. The system of claim 1, wherein the remote module is configured to cause the device to be non-operative at start-up until the remote module issues an appropriate instruction.

18. The system of claim 1, wherein the first attribute of the serial link comprises connectivity.

19. The system of claim 1, further comprising a second serial link which is independent of and performs same functionality as the serial link.

20. A method for implementing enhanced signature checking security measures for protecting a device which comprises a plurality of portions, the system comprising:

connecting a serial link in a remote module, which is integrated or embedded in the device to be protected, to at least some of the plurality of portions of the device, wherein the serial link comprises a first attribute;

connecting a switch in the remote module to operatively control the device;

receiving one or more codes from a control center about a result of checking the first attribute of the serial link;

determining or verifying validity of the one or more codes received from the control center; and issuing one or more instructions to actuate the switch based at least in part on a result of determining or verifying the validity of the one or more codes.

* * * * *